United States Patent [19]

Long et al.

[11] 4,292,786

[45] Oct. 6, 1981

[54] CHOPPED LEAFY VEGETABLE PACKAGING MACHINE

[75] Inventors: Howard W. Long; Robert L. Flowers, both of Wheeling, W. Va.

[73] Assignee: Coronet Foods, Inc., Wheeling, W. Va.

[21] Appl. No.: 80,133

[22] Filed: Sep. 28, 1979

[51] Int. Cl.[3] ..... B65B 1/24; B65B 31/00

[52] U.S. Cl. ..... 53/434; 53/373; 53/436; 53/512; 53/526; 53/527

[58] Field of Search ..... 53/434, 436, 439, 512, 53/523, 526, 527, 373

[56] References Cited

U.S. PATENT DOCUMENTS

| | | | |
|---|---|---|---|
| 2,481,611 | 9/1949 | Moore | 53/526 X |
| 2,669,065 | 2/1954 | Clegg | 53/527 |
| 2,698,500 | 1/1955 | Clegg | 53/526 X |
| 2,925,719 | 2/1960 | Robbins et al. | 53/434 X |

*Primary Examiner*—W. D. Bray

*Attorney, Agent, or Firm*—Harvey B. Jacobson

[57] ABSTRACT

A machine for packaging chopped leafy vegetables in a flexible bag with the chopped leafy vegetables being reduced in volume by compressing the bag and the chopped leafy vegetables therein in a vertical direction and closing the open end of the bag thereby packaging leafy chopped vegetables in a manner that the package will occupy less volume than when the chopped leafy vegetables were in bulk form. In one embodiment of the invention, the bags with a predetermined quantity of chopped leafy vegetables therein are placed on a platform with the open upper end of the bag being received through a slot in a top plate structure after which the supporting platform is moved upwardly toward the top plate a predetermined distance to compress the bag and contents therein in a vertical direction with the upper end of the bag then being closed by a heat sealing assembly when the bag is constructed of plastic. In another embodiment, bags are placed on a lower belt conveyor with the top of the bag being engaged by a pair of side-by-side, laterally spaced top belt conveyors with the space therebetween receiving the open upper end of the bag. The lower and top conveyors move in the same direction and speed and converge in a manner to compress the bag and its contents in a vertical direction while the open end of the bag is sealed with a heat sealing arrangement when the bag is constructed of plastic.

9 Claims, 7 Drawing Figures

CHOPPED LEAFY VEGETABLE PACKAGING MACHINE

BACKGROUND OF THE INVENTION

1. Field of the Invention

The present invention generally relates to a packaging machine and more specifically to a machine for compressing and closing a flexible plastic bag containing a predetermined quantity by weight of chopped leafy vegetables with the volume of the package being reduced so that a larger number of packages can be placed in a container in order to enable more packages to be shipped and stored in a predetermined size load body, storage space, and the like.

2. Description of Relevant Art

In present day food distribution procedures, many restaurants, especially fast-food restaurants, carry-out restaurants and the like, receive chopped leafy vegetables, such as cole slaw, salads and the like, in bulk form. Plastic bags which are heat sealed are conventionally employed to pack the chopped leafy vegetables to facilitate transportation and handling of such material. The leafy chopped vegetables occupy a relatively large volume as compared to its weight which adds considerably to the cost of transporting such material. Usually, a plurality of plastic bag packages of chopped leafy vegetables are placed in a cardboard container and the cardboard containers shipped from the point of packaging of the vegetables to a distribution point or point of use. Various machines are commercially available which will deposit predetermined quantities of materials into flexible bags and then close the bags by using various procedures. When flexible plastic bags are used, the use of a heat sealing technique to close such bags is also well known. The following U.S. patents disclose devices relevant to this field of endeavor:

U.S. Pat. No. 1.923,244
U.S. Pat. No. 2,496,609
U.S. Pat. No. 2,747,350
U.S. Pat. No. 3,541,752
U.S. Pat. No. 3,808,766

SUMMARY OF THE INVENTION

An object of the present invention is to provide a machine for compressing and closing a flexible plastic bag having a predetermined quantity by weight of compressible material therein such as chopped leafy vegetables thereby providing a package occupying a volume less than the volume occupied by the same quantity by weight of the compressible material when in its bulk form.

Another object of the invention is to provide a method of packaging chopped leafy vegetables or the like by compressing the chopped leafy vegetables while in a flexible bag or container such as a plastic bag which expels a substantial quantity of air from the chopped leafy vegetable mass and the bag with the bag being sealed while compressed so that the package will not return to its original volume.

Yet another object of the invention is to provide a method and apparatus in accordance with the preceding objects in which the removal of air from the chopped leafy vegetables and the bag results in the bag conforming with and, in effect, shrink fitting the exterior irregularities in the mass of chopped leafy vegetables, such as lettuce, when it tries to expand after being compressed thus reducing air contact with the vegetables resulting in reduced oxidation and increased shelf life.

A further object of the invention is to provide a packaging machine in accordance with the preceding objects in which a vertically movable supporting plate or platform is provided for receiving a flexible plastic bag with a predetermined weight of chopped leafy vegetables therein with the open upper end of the flexible bag being received through a slot in a top plate with the supporting platform being vertically elevated by a fluid pressure operated piston and cylinder arrangement controlled by a foot operated valve or the like so that the package can be compressed between the supporting platform and the top plate, and the free end of the bag which extends upwardly through the slot in the top plate being heat sealed by utilizing a conventional heat sealing apparatus and technique so that the package will retain its smaller volume when the supporting platform is lowered and the reduced volume package removed from the machine.

A still further object of the present invention is to provide a machine for packaging chopped leafy vegetables or the like in a flexible plastic bag in which a lower belt-type conveyor conveys a flexible plastic bag with a predetermined quantity by weight of leafy chopped vegetables therein in belt form with an upper bulk conveyor overlying the lower conveyor and moving at the same linear speed in the same direction and including two laterally spaced belts for engaging upper surfaces of the bag along opposite sides of the center thereof so that the free upper end of the bag can be engaged by a heat sealing arrangement as the bag passes between the lower and upper conveyors which converge toward each other to compress the bag and the material therein in a vertical manner thus reducing the volume of the package.

Still another important object of the present invention is to provide a packaging machine and method which is simple in construction and operation, easy to use, efficient in operation, long lasting and dependable and especially adapted for use in packaging chopped leafy vegetables.

These, together with other objects and advantages which will become subsequently apparent, reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
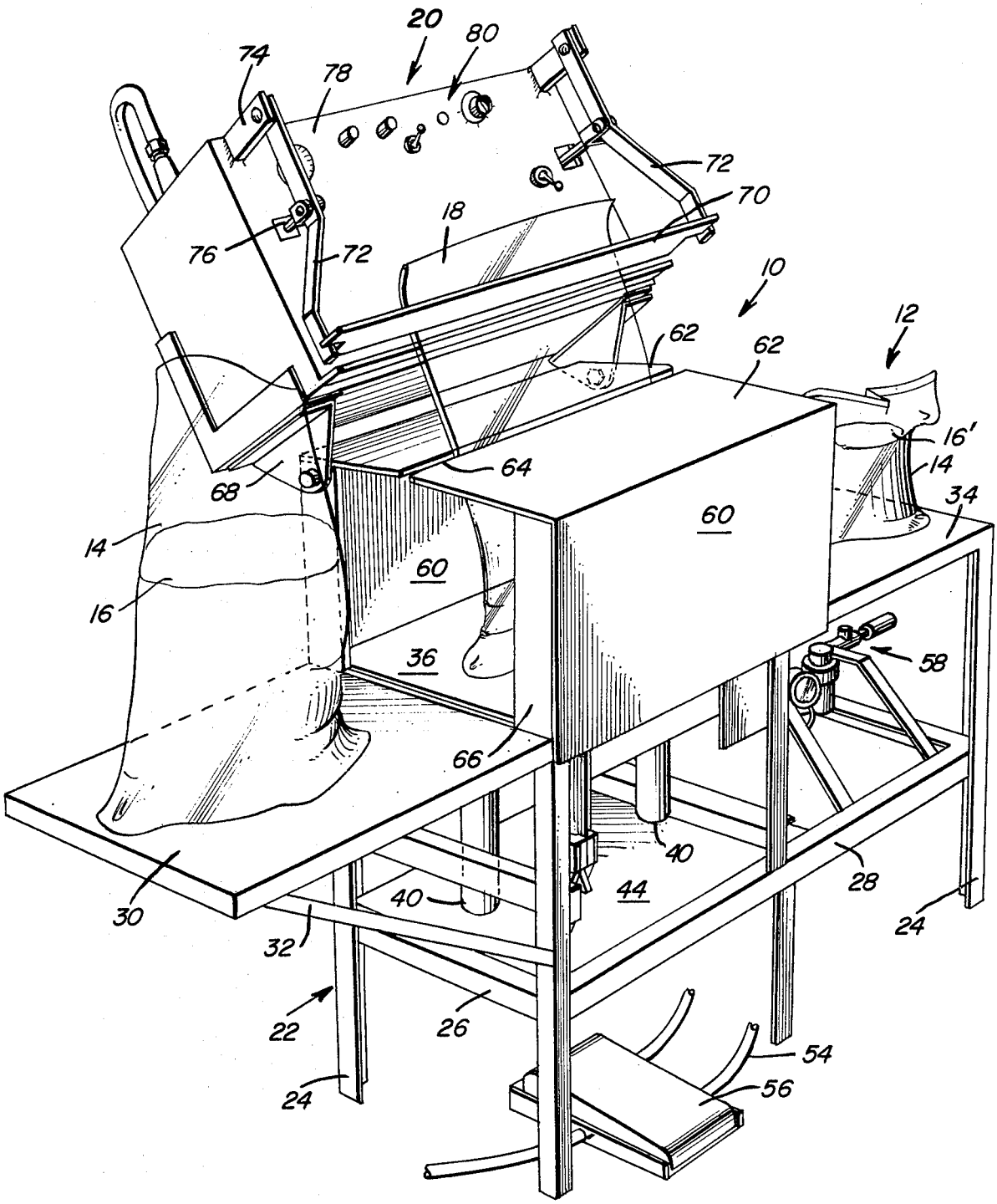
FIG. 1 is a perspective view of one embodiment of the machine of the present invention illustrating the orientation and condition of packages of leafy chopped vegetables as they proceed through the machine.
Figure 2:
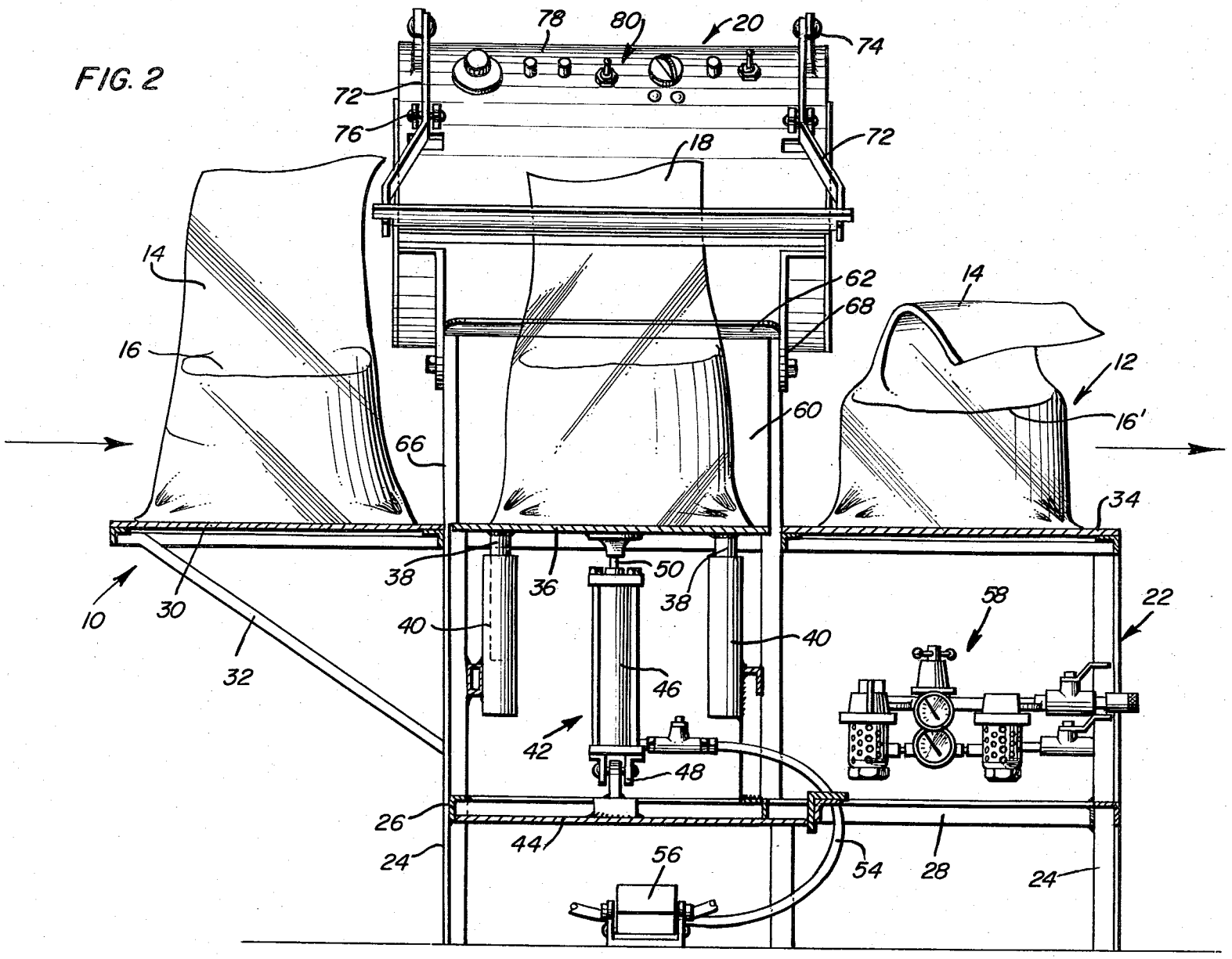
FIG. 2 is a longitudinal sectional view of the machine illustrating the relationship of the supporting platform and top plate.
Figure 4:
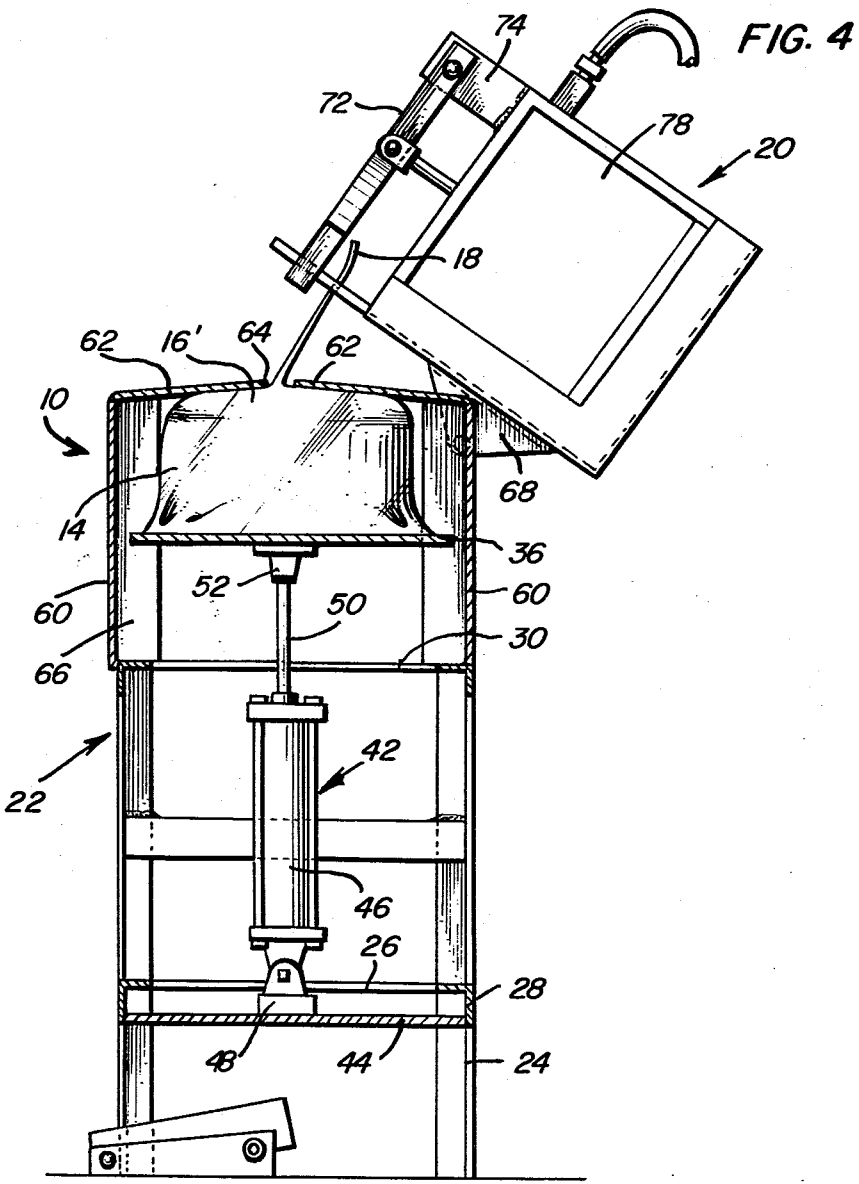
FIG. 4 is a sectional view similar to FIG. 3 and illustrating the machine in position for compressing the package.
Figure 3:
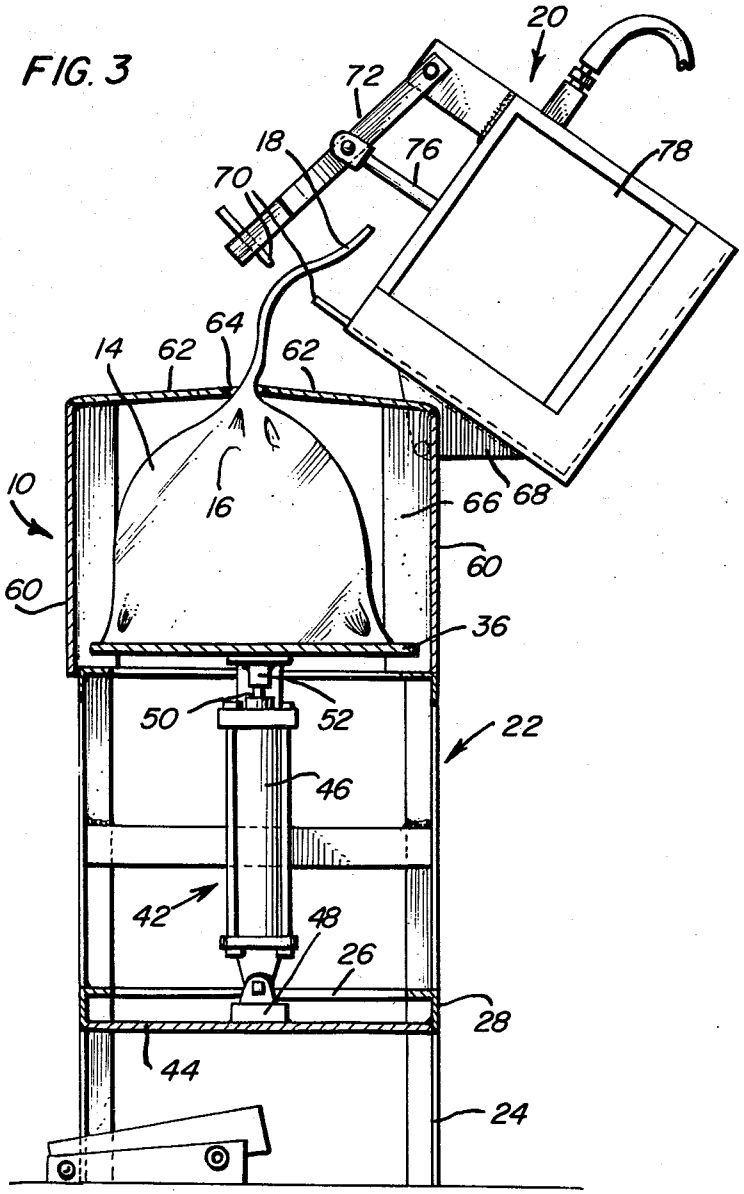
FIG. 3 is a transverse sectional view illustrating the machine with a package therein prior to the package being compressed.

Referring now specifically to FIGS. 1–4, the packaging machine is generally designated by the numeral 10 and is utilized to form a package generally designated by the numeral 12 which is in the form of a flexible plastic bag 14 having a predetermined quantity by weight of leafy chopped vegetables 16 which, when placed in the bag 14, is in bulk form and occupies a substantial volume as illustrated at the left of FIGS. 1 and 2 and as also illustrated in FIG. 3 with the machine 10 compressing the package vertically thus reducing the volume of the chopped leafy vegetables 16 to a smaller volume as indicated by numeral 16' at the right-hand portions of FIGS. 1 and 2 and in FIG. 4 so that the volume of the finished package 12 will be smaller than the bag 14 with the bulk form chopped leafy vegetables 16 therein. Also, the bag 14 has its open upper end 18 closed by a heat sealing apparatus generally designated by the numeral 20 so that a completely closed and sealed package 12 is discharged from the machine 10.

The machine 10 includes a framework of any suitable construction generally designated by numeral 22 and including vertical supporting members 24 interconnected by transverse and longitudinal frame members 26 and 28 with the upper end of the framework 22 including a supporting table or shelf 30 forming a support for the package prior to its entry into the machine with suitable bracing 32 being provided to rigidly support the shelf 30. The framework 22 also includes a horizontally disposed supporting table or shelf surface 34 in alignment with but spaced from the shelf 30 for supporting the finished package as it is removed from the machine.

Centrally disposed and normally in alignment with the shelf or supporting surfaces 30 and 34 is a horizontal supporting platform or plate 36 which is capable of vertical reciprocation from its lowermost position in alignment with the supporting surfaces 30 and 34 as illustrated in FIG. 2 to an elevated position as illustrated in FIG. 4. The platform 36 includes a pair of depending guide rods 38 rigidly affixed to the undersurface thereof which are slidably received in vertically disposed guide tubes 40 rigidly affixed to the framework 22 as by welding or the like, thus providing a guide structure for guiding the vertical movement of the platform 36. While two guide rods and tubes have been shown, if desired, additional guide rods and tubes may be provided as deemed appropriate. For vertically reciprocating the platform 36, a piston and cylinder assembly generally designated by the numeral 42 extends between the platform 36 and a supporting plate 44 supported from the frame members 26 and 28 of the framework 22 with the piston and cylinder assembly 42 including a cylinder 46 pivotally supported and connected with the plate 44 by a suitable bracket and pivotal connection 48 and a piston rod 50 connected with the platform 36 by a bracket structure 52 which may include a pivotal or universal connection. By using a pair of guide rods and tubes and a single piston and cylinder assembly 42 centrally located and pivotally connected only at the plate 44, the platform 36 will be raised and lowered and it will be retained generally in parallel relation to the horizontal surfaces 30 and 34. The piston and cylinder assembly 42 is provided with a conduit 54 connected thereto which is communicated with a fluid pressure system through a foot operated valve 56 conveniently located at floor level and which may be connected with the framework in any suitable manner. Preferably, the piston and cylinder assembly 42 is pneumatically operated and the framework 22 provides adequate support for regulating valves, gauges, controls, filters and the like which are normally employed in a pneumatic supply system for a piston and cylinder arrangement with these components being generally designated by the numeral 58 and schematically illustrated since they may vary depending upon the installational requirements for each installation.

At each side of the platform 36, vertical plates or support members 60 are provided and rigidly attached to the platform in any suitable manner and the upper end of each of plates 60 is provided with an inwardly extending top plate 62 that is inclined upwardly and inwardly with the inner edges of the top plates 62 being spaced to form a slot 64 longitudinally between the inner edges of the top plates 62 as illustrated in FIGS. 1, 3 and 4. The slot 64 provides for passage of the free open upper end of the flexible plastic bag 14 when the bag and material therein are inserted into the machine by sliding the bag horizontally from the shelf surface 30 onto the platform 36 and at the same time the upper end portion 18 of the bag is slid into the slot 64 and the upper edge portion thereof is positioned in the heat sealing mechanism 20. The plates 62 are slightly inclined upwardly and inwardly to provide a slightly inclined surface to the package 12 when it is compressed into the condition illustrated in FIG. 4 which generally comforms with the shape of the upper surface of the chopped leafy vegetables 16 when they are placed in the bag and the bag lifted from the upper end thereof during normal handling. The entrance and exit areas of the machine include inwardly extending side flanges 66 to rigidify the plates 60 with one set of flanges providing a support for bracket structures and bolt assemblies 68 which supports the heat sealing assembly 20 in angular relation to the top plates 62 so that the free upper edge of the bag 18 may be easily placed between a pair of opposed clamping and sealing bars 70. One bar 70 is mounted on a pair of arms 72 pivotally supported at one end by bracket 74 and movable inwardly and outwardly by an actuating rod 76 extending internally of a housing 78 and operable in a conventional manner with the housing 78 including control apparatus 80 all of which forms a part of a standard heat sealing device for plastic film bags that is commercially available and forms no particular part of the present invention except for its association with the other components thereof. The heat sealing device is a commercially available item and is manufactured by Errich International Corp., New York, N.Y., and corresponds generally to the structure disclosed in U.S. Pat. No. 3,012,387. Accordingly, the details of this device are not disclosed other than its unique association with the remainder of the machine. Also, the specific details of the air supply, control valves, regulating valves, gauges and the like are not illustrated in detail since these may vary with each individual installation. For example, various types of strainers, oilers, pressure regulators and the like may be employed and the pneumatic system and cylinder arrangement may be either single acting or double acting and may be hydraulically or pneumatically actuated. The specific details of the framework may vary and may be constructed of bolted construction, welded construction or the like of various materials with the supporting surfaces preferably being easily cleanable in order to maintain appropriate standards of sanitation. The use of the foot control valve enables both hands of an operator to be used in properly positioning the open, uncompressed bag in the machine, inserting the open end of the bag into the heat sealing apparatus and then removing the compressed and closed bag. Since the compression of the bag effectively removes excess air therefrom and sealing of the bag prevents reentry of such air, the upper portion of the bag which is devoid of chopped leafy vegetables will remain in generally a collapsed condition as illustrated in FIG. 1 when it is removed from the machine. This enables a larger number of packages 12 to be placed in a cardboard container or other structure used to transport a plurality of packages 12 to a desired point of distribution or use, thereby reducing the overall transportation cost of delivering the packages to the ultimate point of use.

Figure 5:
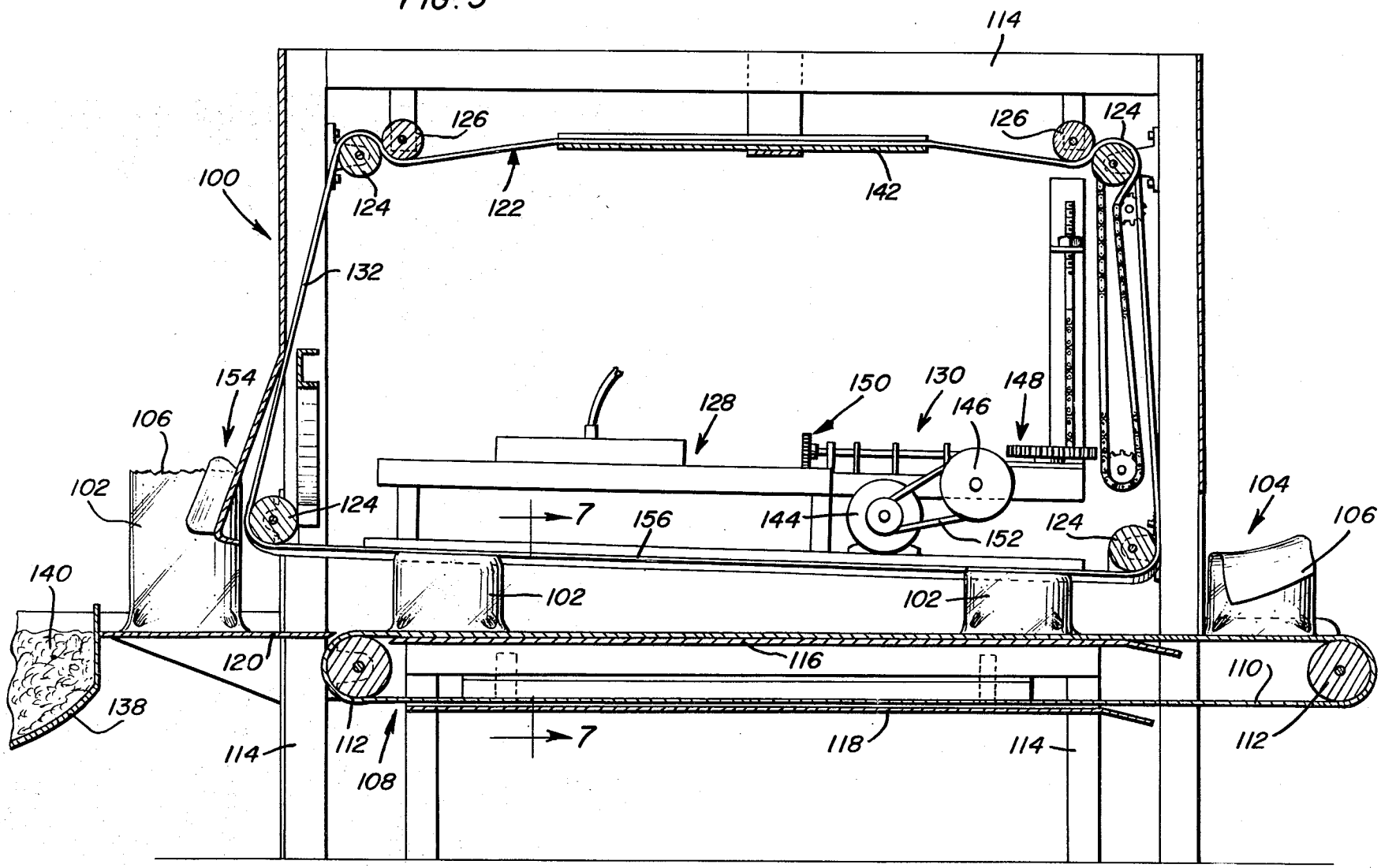
FIG. 5 is a schematic side elevational view of another embodiment of the machine in which the packages are conveyed through the machine as they are compressed and sealed.
Figure 6:
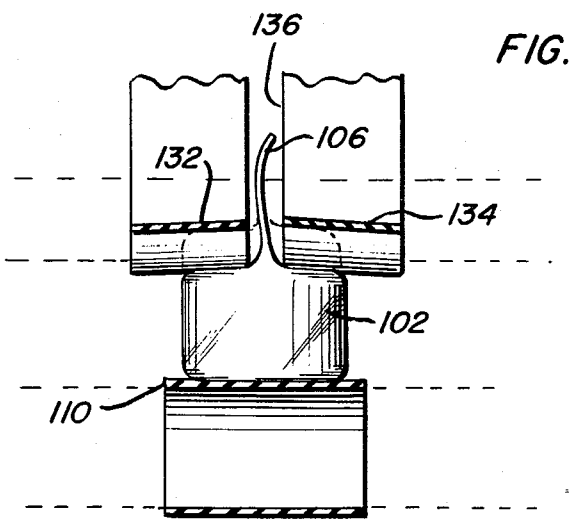
FIG. 6 is a sectional view illustrating the structural relationship of the lower and top belt conveyors illustrating the association of the package therewith.
Figure 7:
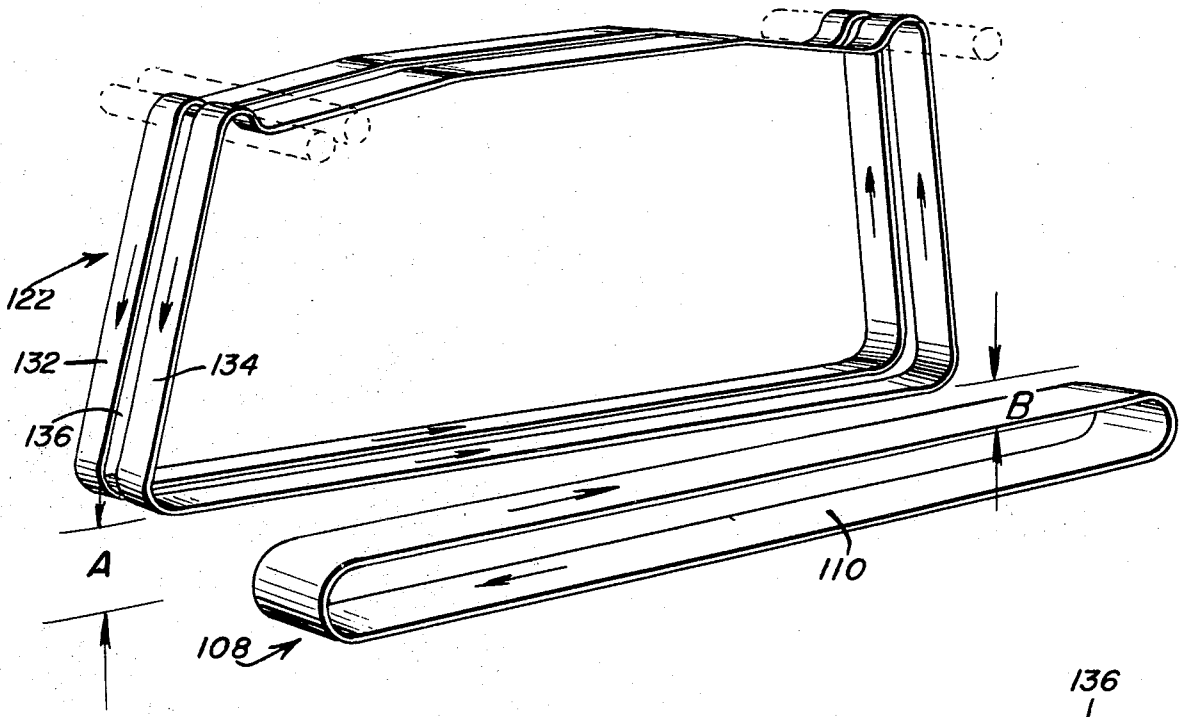
FIG. 7 is a schematic perspective view of the conveyor assemblies illustrating the association thereof.

FIGS. 5–7 illustrate another embodiment of the invention which is semi-automatic in operation and is generally designated by reference numeral 100 which compresses a flexible plastic bag 102 and a predetermined quantity by weight of chopped leafy vegetables therein from a bulk form to a compressed form to provide a package generally designated by the numeral 104 which is smaller in volume than when in the bulk form with the plastic bag 102 having the free open end 106 thereof sealed by a conventional heat sealing technique so that the package 104 produced by the machine 100 is substantially the same as the package 12 produced by the machine 10 illustrated in FIGS. 1–4.

The machine includes a lower conveyor structure generally designated by numeral 108 which includes an endless conveyor belt 110 entrained over end rollers 112 and supported by frame members 114 which are constructed in a conventional manner to provide support for the components of the machine. The belt 110 is preferably of the slider bed type with the upper flight thereof being supported by a slider bed 116 supported from the framework 114. The lower flight of the conveyor belt 110 may also be guided and supported by a bed or other structure 118 so that as the belt 110 is driven with the upper flight thereof generally being horizontally disposed and in alignment with a shelf-like supporting surface 120, the bags with the material therein will be conveyed from the shelf surface 120 along the conveyor belt 110 to a discharge point of the machine. In overlying relation to the lower conveyor 108, an upper conveyor 122 is supported and maintained taut by four vertically spaced and horizontally spaced corner rollers 124 with tension rollers 126 engaging the outer surface of the upper flight of the conveyor 122 which is spaced substantially vertically above the lower flight thereof to provide an area for positioning a heat sealing assembly 128 for the plastic bags 102 and a power mechanism 130 which are disposed above the conveyor 108 and above the lower flight of the conveyor 122.

As illustrated in FIGS. 6 and 7, the conveyor 122 includes a pair of conveyor belts 132 and 134 which are spaced laterally from each other to provide a continuous slot 136 throughout the length of the belts 132 and 134 which overlies and is in alignment with the central area of the conveyor belt 110 as illustrated in FIG. 7 so that the free upper and open end 106 of the plastic bag 102 may project upwardly through the slot 136 along the lower flight of the conveyor belts 132 and 134 for engagement by and heat sealing by the heat sealing mechanism 128. The upper flight of the conveyor belt 110 and the lower flight of the conveyor belts 132 and 134 move at the same linear speed with the lower flight of the belts 132 and 134 converging toward the upper flight of the belt 110 so that the vertical dimension between the entrance ends of the adjacent flights of the conveyor belts as indicated by the arrows labelled A in FIG. 6 is larger than the vertical dimension between the arrows B at the discharge end of the conveyors so that the plastic bag with the chopped leafy vegetables therein is compressed as it moves longitudinally from the entrance end of the machine to the discharge end of the machine with the upper end of the bag also being sealed during its movement through the machine.

The flexible bags 102 may be actually loaded while positioned on the shelf surface 120 from a bin, tub or other receptacle 138 containing a quantity of chopped leafy vegetables 140 or the like. Alternatively, the bags 102 may be preloaded in a machine provided for that purpose with a predetermined quantity of chopped leafy vegetables 140 being placed in each bag 102 in accordance with the weight of the product. The bag and the product therein is compressed and reduced in volume by passing between the conveyors 108 and 122 and through the heat sealing apparatus 128 for heat sealing the open upper end of the plastic bag 102 with the finished package 104 being discharged onto another conveyor or into a container for shipment to the ultimate point of use. The upper flight of the conveyor belts 132 and 134 may be supported and guided by a slider bed 142 or the like supported from the framework 114 in any conventional manner and the rollers 124 and 126 may also be journalled or supported from the framework in any suitable manner with the power system 130 including a motor 144, such as an electric motor, driving an input pulley 146 of a reduction gear unit 148 with a manually operated tensioning device 150 being provided to maintain the drive belt or belts 152, such as V belts, properly tight for effective driving of both conveyors. The specific details of the drive mechanism are not illustrated since this may vary depending upon the specific installational requirements. The shape, size and configuration of the various frame components as well as the conveyor belts may vary depending upon the shape, size and configuration of the plastic bags. Any suitable guide mechanism 154 may be provided at the entrance end of the machine for guiding the open upper end 106 of the bag 102 into the heat sealing mechanism 128 which is conventional in and of itself and includes sealing rollers or bars appropriately heated to heat seal the open upper end 106 of the bag 102 in a well known manner. The specific details of the driving mechanism, supporting mechanism and control mechanism for the conveyors and heat sealing device are not illustrated in detail since such details may vary depending upon the installational requirements for each installation but the essential relationships of the conveyors, the packages and the sealing structure is illustrated.

As illustrated in FIG. 5, the lower flight of the conveyor belts 132 and 134 also include a slider bed 156 which supports the portion of the belts engaging the package and provides a slightly inclined surface to opposite surfaces of the package when compressing the material therein in generally the same manner as the inclined plates 62 in FIGS. 1-4. The belts may be constructed of various materials preferably capable of easy cleaning in order to maintain proper sanitation conditions.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A packaging machine for compressing and closing a flexible bag having a predetermined quantity of compressible product therein to reduce the volume of the product and provide a completed package of less volume than the product in its bulk form prior to compression, said machine comprising a supporting surface for the flexible bag and product with the lower end of the bag adapted to be supported by the surface, an overlying surface engaging the bag where it is in contact with the upper surface of the product in the bag, said supporting surface and overlying surface adapted to approach each other to compress the bag and product therein in a manner to leave the open upper end of the bag accessible for closing the bag after the product and bag have been reduced in volume thereby forming a completed package, said supporting surface being a vertically movable platform, said overlying surface including a pair of plates having adjacent edges slightly spaced from each other to define a slot for passage of the free, open upper end of the bag, and means for elevating the platform a predetermined distance to compress the product and bag after the bag has been positioned on the platform and the free upper end thereof positioned in the slot, said means for elevating the platform including a fluid pressure operated piston and cylinder assembly having one end connected to the platform, a supporting framework for the platform with the other end of the piston and cylinder assembly operatively associated with the framework, guide means interconnecting the framework and platform for guiding vertical reciprocation of the platform, and foot operated means for controlling operation of the piston and cylinder assembly for causing reciprocation of the platform, said framework including a supporting surface in alignment with each end of the platform when the platform is in lowered position to facilitate sliding movement of a bag with the product therein onto the platform, and sealing means for the open upper end of the bag disposed above the slot between the plates.

2. The structure as defined in claim 1 wherein the bag receiving the product is a plastic bag, said closing means for the bag including a heat sealing assembly providing a heat seal along the top of the bag after compression of the product to retain the reduced volume of the package.

3. The method of packaging compressible products such as chopped leafy vegetables in flexible, substantially air impervious bags comprising the steps of placing a predetermined quantity, by weight, of product into the bag in bulk form, compressing the bag longitudinally to compress the product to a reduced volume, and sealing the open end of the bag to maintain the reduced volume, the step of compressing the bag and product including the step of positioning the bag and product on a supported and driven conveyor belt and in underlying relation to a pair of spaced top belts engaging the top surface of the bag and moving the top belts and supporting belt longitudinally at the same speed and in converging relation to compress the bag and product.

4. A packaging machine for compressing and closing a flexible bag having a predetermined quantity of compressible product therein to reduce the volume of the product and provide a completed package of less volume than the product in its bulk form prior to compression, said machine comprising a supporting surface for the flexible bag and product with the lower end of the bag adapted to be supported by the surface, an overlying surface engaging the bag where it is in contact with the upper surface of the product in the bag, said supporting surface and overlying surface adapted to approach each other to compress the bag and product therein in a manner to leave the open upper end of the bag accessible for closing the bag after the product and bag have been reduced in volume thereby forming a completed package, said supporting surface being a conveyor belt having a supported upper flight movable at a predetermined linear speed, the overlying surface including a pair of spaced conveyor belts having a supported lower flight overlying the supporting surface and converging towards the supporting surface longitudinally for compressing the bag and product as the bags and product proceed from one end to the other of the supporting surface.

5. The structure as defined in claim 4 wherein said space between the upper belts provides passage for the open upper end of the bag, said bag being plastic material and heat sealing means above the lower flight of the spaced conveyor belts to seal the bag to maintain the reduced volume of the package.

6. The method as defined in claim 3 wherein the step of sealing the bag includes step of sealing the bag at a point above the upper surface of vegetables and allowing the compressed product to expand thus causing the bag to shrink fit and conform to external irregularities in the mass of chopped leafy vegetables and forming a reduced pressure area within the sealed bag for removing air from the interstices in the chopped leafy vegetables thereby reducing oxidation and increasing the shelf life of the product.

7. A packaging machine for compressing and closing a flexible bag having a predetermined quantity of compressible product therein to reduce the volume of the product and provide a completed package of less volume than the product in its bulk form prior to compression, said machine comprising a supporting surface for the flexible bag and product with the lower end of the bag adapted to be supported by the surface, an overlying surface adapted to engage the bag where it is in contact with the upper surface of the product in the bag, said supporting surface including a vertically movable platform, and a stationary supporting surface in alignment with the platform when the platform is in lowered position to facilitate sliding movement of a bag with the product therein onto the platform, said overlying surface including a pair of plates having adjacent edges slightly spaced from each other to define a slot for passage of the free, open end of the bag, means for elevating the platform a predetermined distance to compress the product and bag after the bag has been positioned on the platform and the free upper end thereof positioned in the slot, and sealing means for the open upper end of the bag disposed above the slot between the plates.

8. The structure as defined in claim 7 wherein the bag receiving the product is a plastic bag, said pair of plates being inclined inwardly and upwardly to provide inclined surfaces to the upper surface of the product, said sealing means for the bag including a heat sealing assembly providing a heat seal along the top of the bag after compression of the product to retain the reduced volume of the package.

9. The method of packaging compressible products such as chopped leafy vegetables in flexible, substantially air impervious plastic bags comprising the steps of placing a predetermined quantity, by weight, of product into the bag in bulk form through an open upper end, supporting the bag on a vertically movable platform with the open end disposed upwardly, inserting the open upper end of the bag into a slot in an overlying member, moving the platform upwardly to compress the bag and product longitudinally to compress the product to a reduced volume while retaining the open end of the bag in the slot, sealing the open end of the bag to preclude entry of air to maintain the reduced interior volume of the bag, lowering the platform and removing the bagged product therefrom with return of the product toward bulk form causing reduced pressure within the sealed bag.

* * * * *